United States Patent [19]

Lindgren

[11] Patent Number: 4,934,617

[45] Date of Patent: Jun. 19, 1990

[54] APPARATUS FOR FORMING A COIL OF LINE

[76] Inventor: Peter B. Lindgren, 871 SW. 19th St., Boca Raton, Fla. 33486

[21] Appl. No.: 309,677

[22] Filed: Feb. 13, 1989

[51] Int. Cl.[5] ..... B65H 54/02; B65H 55/00; B65H 75/22

[52] U.S. Cl. ..... 242/47; 242/110; 242/115; 242/157 R; 242/158.3; 242/159

[58] Field of Search ..... 242/159, 176, 47, 53, 242/25 R, 54 R, 110, 110.1, 110.2, 110.3, 115, 50, 1, 158.3, 158 R

[56] References Cited

U.S. PATENT DOCUMENTS

| | | | |
|---|---|---|---|
| 952,005 | 3/1910 | Fetherolf | 242/50 |
| 1,885,192 | 11/1932 | Elssner et al. | 242/110.1 |
| 1,901,226 | 3/1933 | Carter | 242/110.1 |
| 1,928,979 | 10/1933 | Levison | 242/110.1 X |
| 2,519,461 | 8/1950 | Hanson | 242/158.3 |
| 2,839,258 | 6/1958 | Jacobson | 242/110.2 |
| 2,971,721 | 2/1961 | Jones | 242/110.2 |
| 4,147,310 | 4/1979 | Harden et al. | 242/110.1 X |
| 4,674,701 | 6/1987 | Dreher et al. | 242/110.2 |

*Primary Examiner*—Stanley N. Gilreath
*Attorney, Agent, or Firm*—Jack E. Dominik

[57] ABSTRACT

An ultimate product which is a package of coiled line is disclosed. The package includes the coiled line exteriorly of a demountable spool. The demountable spool is ideally formed by two members, each identical to the other, and interfitting with each other in order to provide support of the coil at a spacing of 90°. A companion to the invention of the line package, is the method of winding the line on the spool which comprises supporting between the four support members of the demountable spool in an arcuate fashion, or its equivalent, those portions of the line which are intermediate the support members of the demountable spool. After the demountable spool has been totally wound or coiled with the line, the arcuate support portion or its equivalent is removed, and the package of line remains with its essential annular coil on the demountable spool.

3 Claims, 4 Drawing Sheets

APPARATUS FOR FORMING A COIL OF LINE

FIELD OF THE INVENTION

The present invention relates to a package of line, ideally used in the fishing industry, which is spooled or coiled for shipment to a customer. Such line for long line usage may be approximately 3.5 millimeters in diameter, and the packages are nominally 25 pounds to 50 pounds which nominally contains between one-half and one nautical miles of line. The package may also be used for winding other lines and cables of comparably small diameter.

SUMMARY OF THE BACKGROUND ART

Large quantities of line or strands of material are presently being fabricated and distributed to a wide variety of industries. By way of example, the fishing industry requires large quantity of monofilament fishing line on a daily basis. Such fishing line may have diameters of one-eighth inch and be of lengths in excess of one mile weighing fifty or more pounds. The industry would like to purchase line in packages which contain long, continuous lengths of such line.

Current packaging for fishing line is normally in a large unsupported coil with strings or tie wraps to keep the line from becoming entangled during shipment and use. A problem arises when the customer wants to unwind the coil for use or for subsequently respooling of the line. The customer must either make a mandrel or some sort of fixture to support the line during unwinding. If this is not done and the coil is unwound, a twist is imparted in the line for each revolution of the coil. Such a twist is undesirable since it causes tangling during further use of the line. What the market prefers is to purchase the product already wound on a spool. Such an arrangement is desirable for shipping, storage and unwinding. Unfortunately, such is very costly. Known spools also require large storage space prior to initial line winding. They are also bulky and expensive to ship empty when returning the spool to the manufacturer.

What is desired is a method and apparatus for winding line in an organized manner on a device which will support the line for shipment and which will support the line on an axle during unreeling. Further, a preferred apparatus must be inexpensive, compact, lightweight and reusable.

Various approaches are disclosed in the literature to improve the efficiency of winding and reeling line for use by industry. By way of example, note U.S. Pat. No. 4,238,086 to Brimmeier and U.S. Pat. No. 4,192,473 to Wellman. According to those disclosures, a simplified reel is fabricated of component elements which, in theory, might be disassembled for constituting a relatively flat package for returning the reel to the manufacturer after use. The devices disclosed by these patents, however, do not employ a demountable reel for winding and dispensing the line.

In U.S. Pat. No. 1,977,668 to Dallas, line is wound onto a mandrel. Thereafter, the mandrel is collapsed so that the wound material may be removed. During shipment, there is no structure for supporting the wound line from the interior whereby it may be mounted on a spindle for subsequent unreeling. Similar to Dallas, U.S. Pat. No. 1,317,500 to Holmquist and U.S. Pat. No. 1,414,380 to Sommer also disclose mechanisms upon which line material may be wound and, whereafter, the mechanism may be collapsed so that the unsupported wound material may be shipped. Kinnicut in U.S. Pat. No. 3,861,615 discloses mechanisms for reeling line to generate a coil. According to the Kinnicut disclosure, however, the wound line is then provided with an interior brace to support the coil during shipment.

Lastly, U.S. Pat. No. 2,019,857 to Hoover discloses a tape winding reel wherein the wound line for winding a coil of material within the container, removably mounted about a reel, in such a configuration that the center portion of the coil is unwound first with the unwinding proceeding outward from the center.

SUMMARY OF THE INVENTION

The present invention is directed to an ultimate product which is a package of coiled line. The package includes the coiled line exteriorly of a demountable spool. The demountable spool is ideally formed by two members, each identical to the other, and interfitting with each other in order to provide for support of the coil at a spacing of 90°. The ultimate package can be secured in a shipping container which is of nominal dimension, and where the weight of the spool and container is less than 10% of the weight of the line to be used. A companion to the invention of the line package, is the method of winding the line on the spool which comprises supporting between the four support members of the demountable spool in an arcuate fashion, or its equivalent, those portions of the line which are intermediate the support members of the demountable spool. After the demountable spool has been totally wound or coiled with the line, the arcuate support portion or its equivalent is removed, and the package of line remains with its essential annular coil on the demountable spool. When the spool is shipped to the customer and it is used, the central portion of the demountable support has ideally a tubular axle receiving portion. The line can be unwound while the axle is vertical or horizontal. Upon conclusion of the unwinding of the line, the demountable spool is disassembled, and readied for reshipment to the supplier in its flat form, and consuming less than 10% of the cube upon reshipment as was shipped to the customer with the spool of line. Specifics of the method contemplate arcuate segments which are positioned between the arms of a demountable spool, and secured in place firmly to blend in with the extensions of the demountable spool to essentially comprise a cylindrical winding surface. Ideally the line is level wound onto the demountable spool and its central cylindrical coil forming member, and upon completion of the winding, the central forming portion segments are collapsed or otherwise disabled from interfering with removing the demountable spool and its thus-coiled line from the winding apparatus. Thereafter the demountable spool and its line is packaged and shipped to the customer, oftentimes with the same demountable spool as the customer had returned.

In view of the foregoing a principal object of the present invention is to provide a package of coiled line including a demountable spool which is self-storing and selfjigging and which has a minimum number of supporting parts with a line which is essentially annular or cylindrical at the peripheral portion of the package.

A related but important object of the present invention is to provide such a package of line with a centrally disposed demountable spool which, because the two elements are identical, and can be slidingly engaged each with the other, and can be demounted and shipped in flat form.

Yet another object of the present invention is to provide for a method of winding the type of line package as set forth above which method, and apparatus, is essentially simple, includes a master/slave relationship between the winding of the spool and the level winding of the line and which results an essentially annular well disciplined coil of line on the demountable spool.

BRIEF DESCRIPTION OF THE DRAWINGS

Further objects and advantages of the present invention will become apparent as the following description proceeds, taken in conjunction with the accompanying drawings, in which.

DESCRIPTION OF PREFERRED EMBODIMENTS

Figure 1:
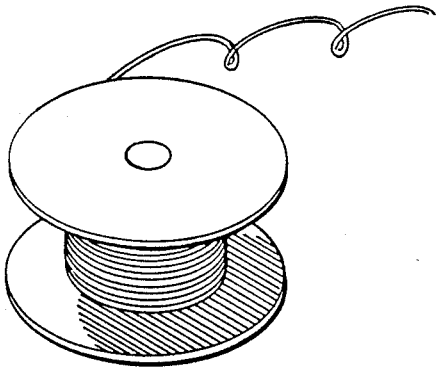
FIG. 1 PRIOR ART
FIG. 1 is illustrative of the type of line coils of the prior art in which the spool has a pair of opposed flat sides, and a central cylindrical core.

Prior to describing the preferred embodiment, the prior art as noted in FIG. 1 requires some comment. While FIG. 1 discloses a prior-art coil of line on a spool, oftentimes the line is unsupported and just coiled in a bale, and the line removed therefrom. In either event, it must be rotated once to get rid of each coiled portion. Furthermore, it requires an expensive spool in the form as shown in FIG. 1, and, therefore, the less expensive construction such as an unsupported coil is more prevalent. Again, both have the problems of twisting upon unreeling unless centrally disposed for even removal.

Figure 2:
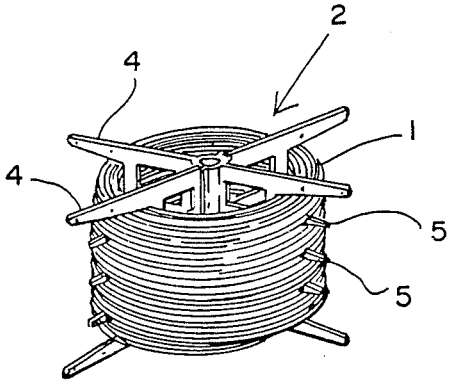
FIG. 2 is a perspective view of a typical coil of line manufactured in accordance with the present invention illustrating the two demountable spool sections, and their respective extending figures.
Figure 3:
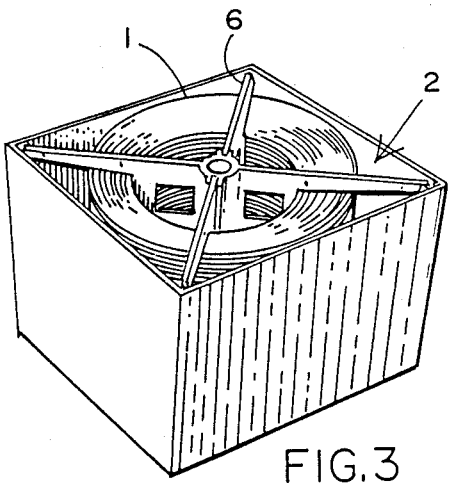
FIG. 3 is a perspective view of the package as taken from FIG. 2, and illustrating how the same is packaged in a carton.
Figure 4:
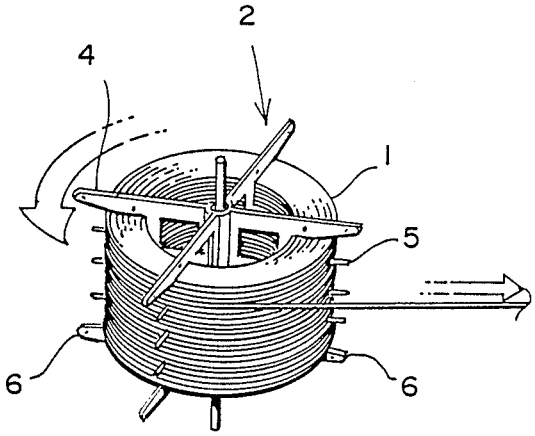
FIG. 4 is a perspective view of the subject package as it is mounted for decoiling or dewinding by the customer, and showing how the line pays out when the spool is mounted on a vertical shaft.
Figure 5:
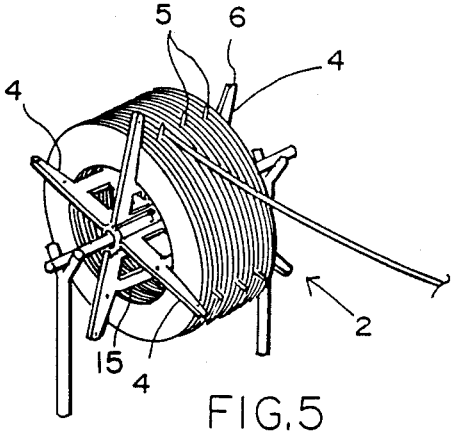
FIG. 5 is a sequential perspective view of FIG. 4 above, but showing the shaft for unwinding in the horizontal direction, and more particularly showing the unwinding phase of the use by the customer.
Figure 6:
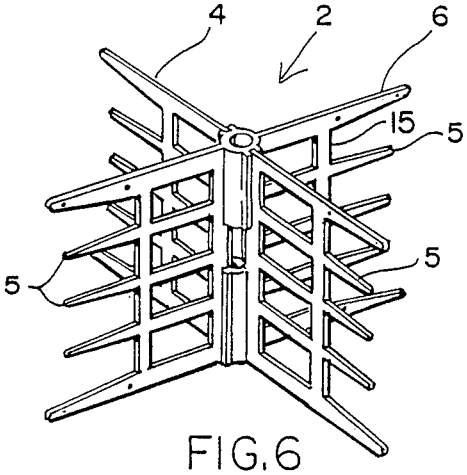
FIG. 6 is a perspective view sequential to that of FIG. 5 above, and illustrating the demountable spool totally devoid of its line which is wound, and immediately prior to disassembly for reshipment.
Figure 7:
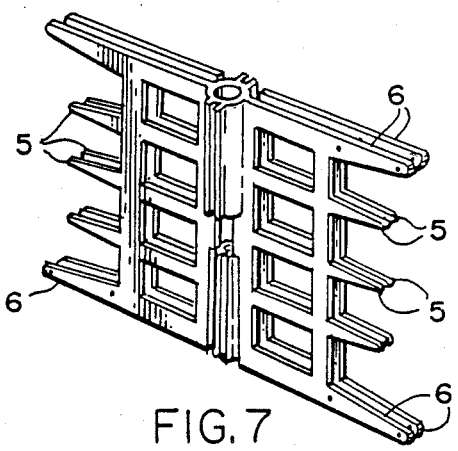
FIG. 7 is a perspective view subsequent to that if FIG. 6 above, showing the two halves of the demountable spool after disassembly, and readied for shipment in return to the factory.

The line package 1 illustrative of the present invention is best shown in FIG. 2. There it will be seen that the coil of line is actually impaled or formed on a spool 2. The spool 2 is made up of two identical demountable members 4. The demountable members 4 have a plurality of stabilizing fingers 5 extending exteriorly, and the central stabilizing fingers 5 are flanked by the exterior containing fingers 6 which in most instances extend somewhat further than the central stabilizing fingers 5. As noted in FIG. 3, the line package 1 as illustrated in FIG. 2 can be readily positioned interiorly of a carton for shipment. When the carton arrives with the customer, he normally mounts in the same in either a vertical or horizontal orientation for unwinding as illustrated in FIGS. 4 and 5. Once the line is removed from the spool 2, it then presents the same configuration as shown in FIG. 6. Subsequently to unwinding the entirety of the line from the spool 2, as illustrated in FIG. 7, the two demountable members 4 are laid together in flat face-to-face relationship, and are then ready for reshipment back to the line manufacturer for reuse.

Figure 8:
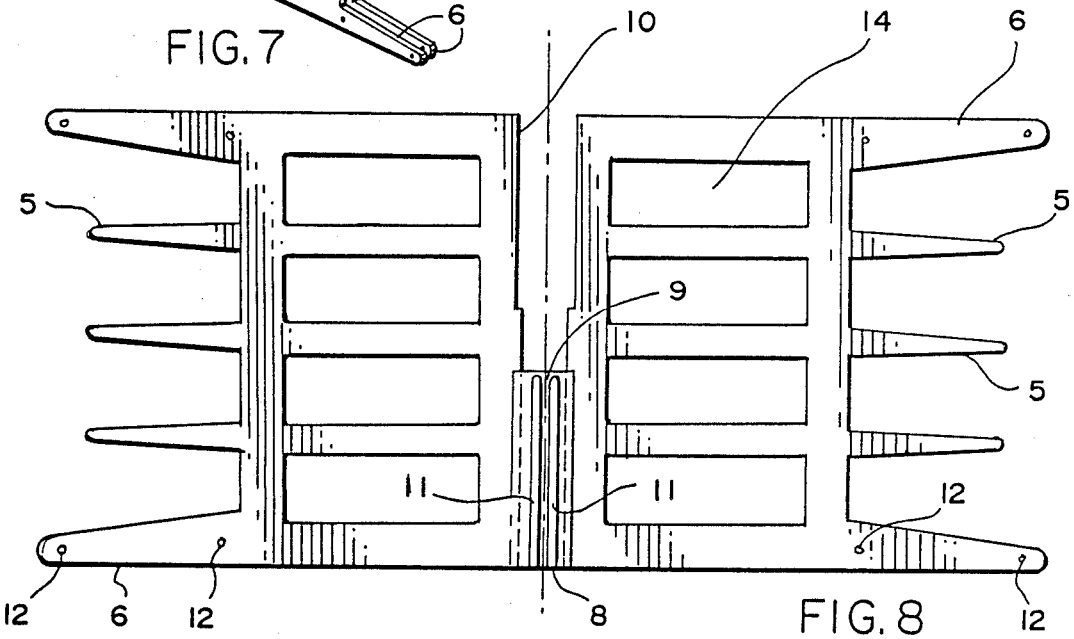
FIG. 8 is a plan view of one of the demountable spool portions (the other portion being identical to that shown)
Figure 9:
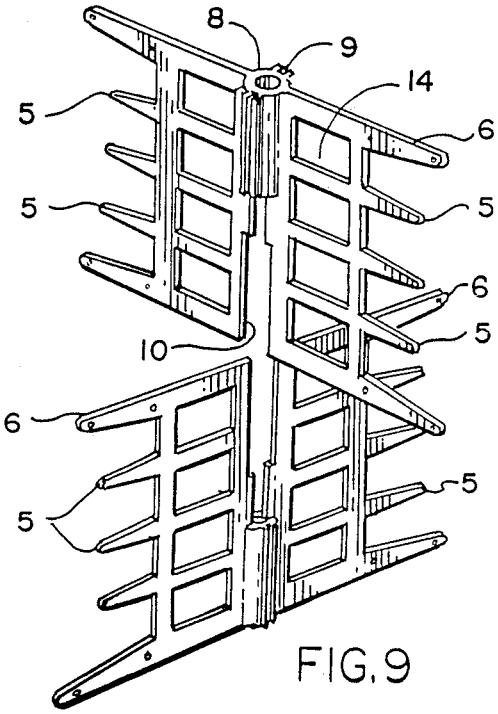
FIG. 9 is an exploded perspective view of the two demountable members shown assembled in FIG. 6 above, and illustrating particularly the provision for shaft receiving members at the central portion of the demountable spool.

The specific construction of the demountable members 4 is best shown in FIG. 8. There it will be seen that a cylinder 8 is provided at a lower portion or one central end portion of the demountable member 4. The cylinder is hollow to provide for the insertion of an axle for unwinding. At the opposite portion of the cylinder 8 there are slot rails 10 which, in turn, intersect and fit within the mounting slot 9 which is comprised of two slot forming members 11 on the exterior portion of cylinder 8. As shown in FIG. 9, when the two demountable members are positioned for assembly into a spool 2, each is positioned to move axially into the mounting slot 9, and then very simply form the spool 2. In greater detail, it will be seen that line tie eyes 12 are provided in exterior fingers 6, and are used to tie the line after being wound on the body.

In a typical commercial embodiment, the length between the ends of the exterior finger 6 is approximately twenty-four inches. The distance between the ends of the coil support 15 which determines the interior diameter of the spool of line is approximately sixteen inches, with the distance between parallel adjacent tips of the exterior fingers being approximately twelve inches. The thicknesses of the demountable members 4 are such that each demountable member weighs slightly less than one pound, thereby making the tare weight of the line package 1 slightly less than two pounds.

With a 3.5 millimeter monofilament line, approximately one mile of line can be wrapped on the commercial embodiment as just described. The coil is formed on the spool 2 of a length of approximately one mile in approximately one hour. The invention is independent of the speed of forming the line package 1, and the speeds and lengths of line are recited here for purposes of exemplifying the actual commercial usage. Finally, with the approximate one mile of 3.5 millimeter monofilament nylon line, the spool 2 and line package 1 together weigh approximately fifty pounds.

Figure 10:
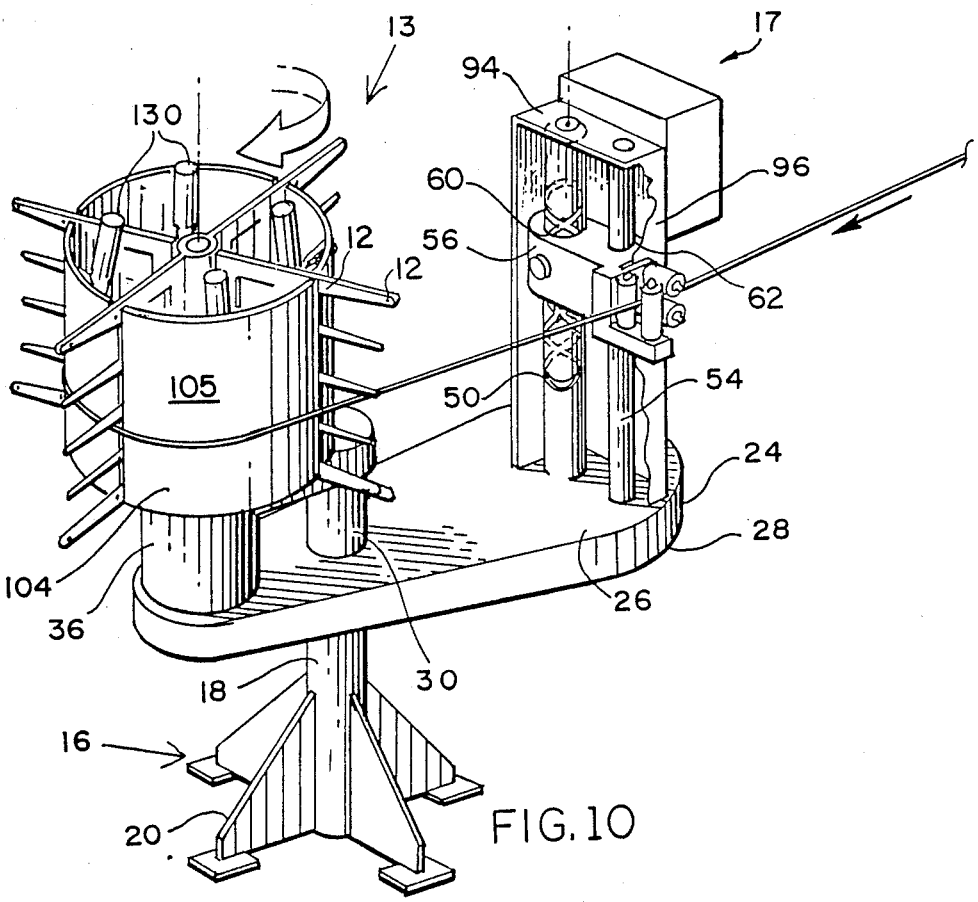
FIG. 10 is a perspective partially diagrammatic view of a winding mechanism intended for use in winding line with the demountable spool and to form a package as contemplated by the present invention.
Figure 11:
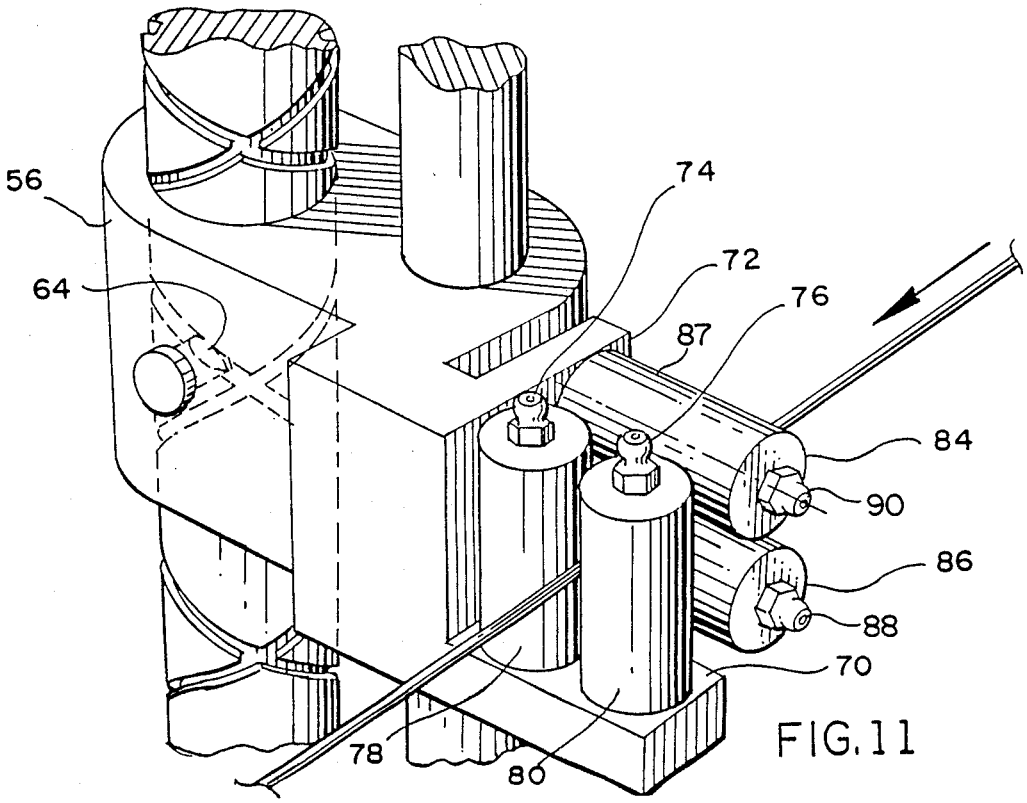
FIG. 11 is a perspective view on an enlarged scale of the the level wind mechanism shown in FIG. 10 above.

Shown in FIG. 10 is a line winding system constructed in accordance with the principles of the present invention. From a broad standpoint, the system includes the winding assembly 13 and the line leveler 17 arranged in operative relationship with respect to each other on a common support assembly 16. The support assembly 16 includes a main vertical support post 18 having legs 20 at its lower end for providing proper balance and positioning for the winding assembly and line leveler. At an intermediate location along the support post there is secured a safety shroud 24 formed of an upper horizontal surface 26 and side walls 28 depending from the periphery of the upper surface 26. The upper end of the support post 18 receives an upper horizontal support brace 30.

Figure 12:
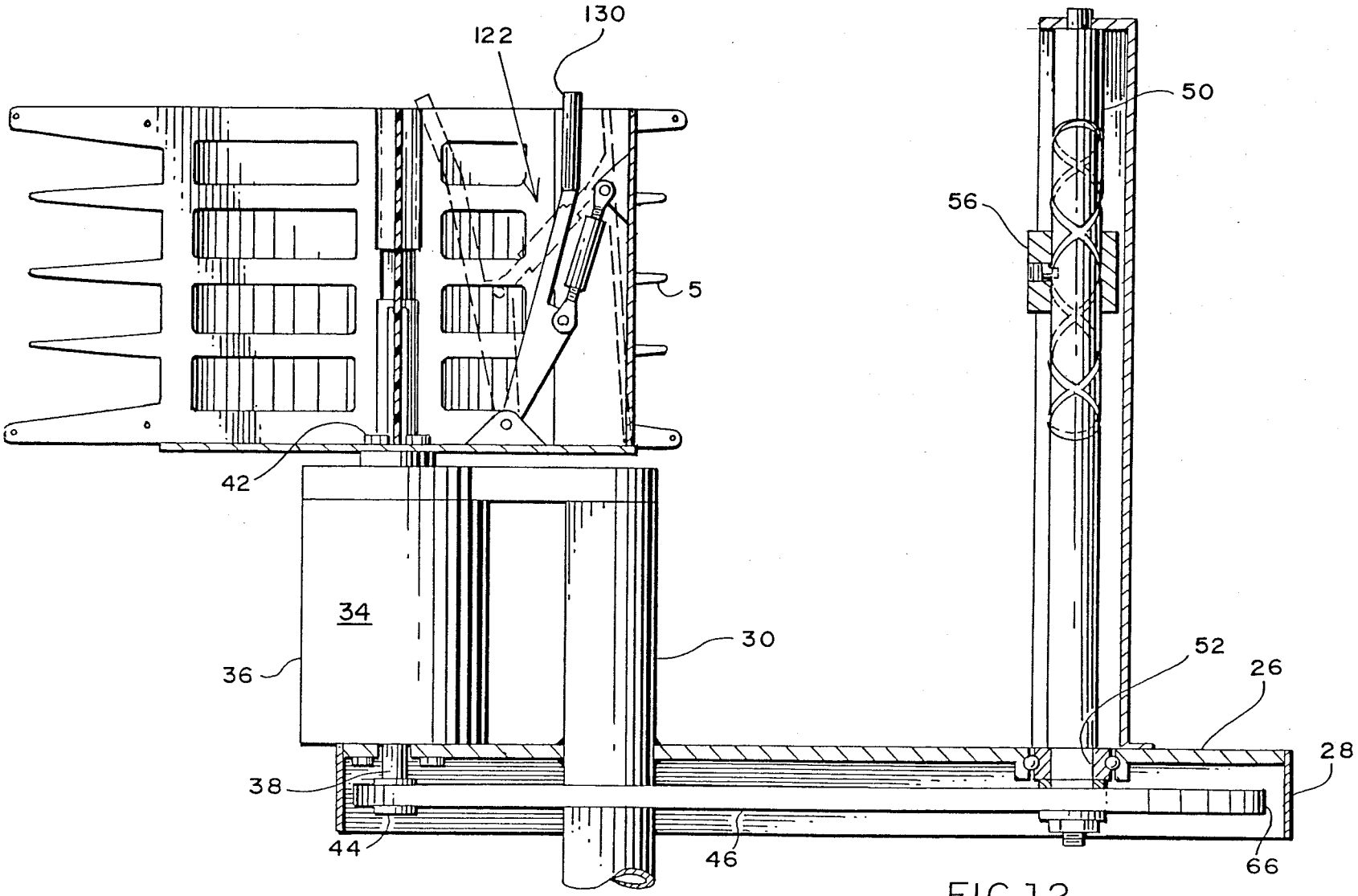
FIG. 12 is a front elevation, partially in phantom form, showing the interior mechanism of the winding member and more particularly the turnbuckles employed to insure that the coiling mechanism centrally of the extending fingers jigs or assists in forming the annular package.

Extending upwardly from one side of the shroud 24 is a motor 34 and housing 36. The motor 34 as a central drive shaft 38 the upper end of which receives and supports the secondary reel or mandrel 104 through bolts 42 for rotation during operation and use. The lower end of the drive shaft 38 is provided with a pulley 44 (see FIG. 12) for driving a belt 46 and, in turn, the line leveler 17.

Extending upwardly from the other side of the shroud 24 is the line leveler 17. The main component of the line leveler 17 is a vertically extending jack screw 50 secured to the shroud through a bearing assembly 52. Also located on the shroud 24 is a fixed guide rod 54 positioned parallel with, and closely spaced from, the jack screw 50. A collar 56 is located on the jack screw 50 and guide rod 54. It is provided with apertures 60 and 62 for receiving the jack screw 50 and guide rod 54 to define its path for reciprocal motion vertically with respect to the jack screw 50 and guide rod 54 as well as the winding assembly 13. Extending horizontally through an aperture in the collar is a pin 64 for being received in the threads of the jack screw 50. Rotation of the jack screw 50 about its axis is effected by the drive belt 46 through a pulley 66 secured to the lower end of the jack screw 50. Rotation of motor 34, the lower end of shaft 38, pulley 44, drive belt 46 and pulley 66 will thus rotate the jack screw 50 and, consequently, drive the pin 64 and collar 56 in a vertical reciprocal path of movement along the jack screw 50 and guide rod 54 during operation and use any time the winding assembly 13 is driven.

Located to one side of the collar 56 is a horizontal ledge 70 and a vertical ledge 72 adapted for movement with the collar 56. The horizontal ledge 70 has two vertically extending support shafts 74 and 76 for receiving a pair of parallel idler rollers 78 and 80 through which the line to be fed may pass. Similarly, a parallel pair of horizontally disposed rollers 84 and 86 are freely rotatable on support shafts 88 and 90 extending horizontally from the vertical ledge 72 of the collar 6. One of the rollers of each of the pairs is spring biased, in the conventional manner, perpendicular to its axis for movement toward its adjacent associated roller. As such, movement of line through the pairs of rollers will rotate the rollers and vertically reciprocate and concurrently guide the line as it is received by the winding assembly 13 for directing the movement of the line to the winding assembly 13. A horizontal plate 94 is located above the jack screw 50 and guide rod 54 for receiving the upper ends of jack screw 50 and guide rod 54 in a journaled manner. A three sided cover 96 with an open slide is located on the side of the line leveler 17 for safety purposes and to enclose the controls.

In operating the winding assembly 13 of the present invention, the mandrel 104 is expanded by an operator through a turnbuckle assembly 122 (see FIG. 12) to lock the spool 2 in the expanded position as shown in FIG. 10. If desired, the mandrel 104 sections 105 may be contracted prior to receiving the spool assembly 2. In such case, the mandrel 104 is expanded prior to preparation and use by the operating handle 130. The line coming off of an extruder or other source is then fed through the horizontal and vertical rollers 84, 86 and 78, 80 of the line leveler 17. The leading edge of the line is then passed through a radially interior eye 12 of one of the extension fingers 6 for securement purposes. Power is then applied to the system through the motor 34 so that the winding assembly 13 will rotate for winding line thereon. Concurrently with the movement of the motor 34 and rotation of the drive shaft 38, the belt 46 will also rotate the jack screw 50 to effect the vertical reciprocation of the collar 56 to insure that the line is continuously fed in an even manner over the entire periphery of the winding assembly 13.

The power of the unit, even at its maximum setting, should be very low. Thus winding can be stopped by gripping the line and pulling with the mere pressure of a few pounds. Thereafter the speed will come up to accommodate the maximum delivery speed. At the end of the desired coil, the line is cut. The cut trailing end is then fed through another eye 12 at an exterior end of one of the fingers 6. Stress is then relieved from the coil by orienting the turnbuckle assemblies 122 inwardly to collapse the mandrel 104. This facilitates the lifting of the spool assembly 2 upwardly with the wound line thereon whereafter it may easily be shipped for operation and use.

The present disclosure includes that contained in the appended claims as well as that of the foregoing description. Although the present invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed is:

1. Apparatus for forming a coil of line, including a demountable central spool having a plurality of interior and exterior fingers on said spool terminating in a coil support comprising, in combination, a winding mechanism including a drive and means for receiving said spool, a plurality of arcuate members for positioning between the exterior fingers of said spool to form therewith a cylindrical mandrel-like structure, and means for guiding line to the spool for winding the line on the spool.

2. Apparatus for forming a coil of line according to claim 1, wherein said guiding means includes, a level wind mechanism for guiding the line to the subject spool.

3. Apparatus for forming a coil of line according to claim 2, wherein, said level wind mechanism has means for slaving to the drive for the spool for permitting level wind in timed relationship to the rotation of the spool.

* * * * *